United States Patent [19]

Pöhlman et al.

[11] 4,372,127

[45] Feb. 8, 1983

[54] APPARATUS FOR HEAT TRANSFORMATION

[75] Inventors: Erich Pöhlmann, Kulmbach; Hans-Peter Doetsch, Altdrossenfeld, both of Fed. Rep. of Germany

[73] Assignee: Christian Schneider, Kulmbach, Fed. Rep. of Germany

[21] Appl. No.: 205,719

[22] Filed: Nov. 10, 1980

[30] Foreign Application Priority Data

Nov. 14, 1979 [DE] Fed. Rep. of Germany ..... 2945973

[51] Int. Cl.[3] ..... F25B 9/00

[52] U.S. Cl. ..... 62/6

[58] Field of Search ..... 62/6

[56] References Cited

U.S. PATENT DOCUMENTS 3,220,201 11/1965 Heuchling et al. ..... 62/6

3,991,586 11/1976 Acord ..... 62/6

FOREIGN PATENT DOCUMENTS 185940 7/1965 U.S.S.R. ..... 62/6

*Primary Examiner*—Albert W. Davis, Jr.

*Attorney, Agent, or Firm*—Orville N. Greene

[57] ABSTRACT

A heat transformation device which is compact and effective for recovering waste heat from one or more sources which sources may have different temperatures, comprises a closed cylinder containing a working piston made of heat conducting material and at least one impact piston which is constructed to act as a recuperator. Electromagnetic means are provided to suddenly move the impact piston when it absorbs heat from an end of the cylinder into contact with the working piston. The cylinder is filled with a low molecular weight, low density gas which has high specific heat and is preferably compressed.

24 Claims, 2 Drawing Figures

APPARATUS FOR HEAT TRANSFORMATION

The invention relates to an apparatus for heat transformation. Heat exchangers for the transformation of heat into different temperature ranges and temperature breadths are known. All of the known heat transformers are accompanied by the requirement that proportionately large heat transfer surfaces are necessary for the transformation of heat. As a result the structural mass of the known heat transformers can not be decreased below a fixed size with respect to surface area and volume. Added to this, due to the great volume of lost space, in each case the working media employed can require a desirable ratio with respect to the size of the heat transformer.

For reasons of better heat conversion and considerations of weight relationships, working media are employed which must change their state of aggregation during the cycle.

Finally the known installations are not efficient in the range of the higher or lower temperatures. Their insertion for spreading of heat over a certain temperature range are likewise limited. The exhibited ranges have been naturally enlarged through purely technical measures. Here, however, the range is limited due to the inefficiency of these technical means. One is reminded for example of polystage applications.

This invention is based on the problem of making a heat transformer which permits the formation of a spatially small, closed aggregate with an essentially better efficiency not only of the heat conversion surfaces but also of space of the working media. Thereby the energy costs not only for heating but also for cooling can be kept low.

The invention solves these problems through an apparatus for heat transformation with a driving piston which on its part can be impelled in either direction and a displacing piston which at the same time has a built-in inner regenerator and which is movable under the influence of one or more impressed electromagnetic fields acting from the outside.

Through this arrangement, the displacer piston including the regenerator can be moved very quickly, almost suddenly, under the influence of the electromagnetic field or fields, in constrast to the known embodiments wherein a movement is carried out in the form of a sine wave or almost sine wave.

The quick movement of the displacer piston together with the regenerator yields a high Reynolds number which, for its part, fulfills the provision that only a very small heat transfer surface is necessary. This is the provision for the desired small and sturdy mode of structure which simultaneously results in the elimination of the space loss described above. This further, combined with the desired small size of structure can be driven with very low frequency, which as the direct result that the life of the apparatus is correspondingly prolonged with the lowest cost of maintenance.

The discharge of motion of the displacing piston, which is no longer dependent on a mechanical drive, permits dwell phases in the final position under metallic heat transfer contact. The electromagnetic high initial acceleration impressed on the displacing piston permits the construction of stronger, more ordered and more lasting whirl of working media in the working space.

With the extraordinarily high heat transfer obtainable by the apparatus of the invention the choice of a suitable working medium presents itself as a resulting problem. The known work media operate in different states of aggregation, they are only useful within a certain range of temperatures. By their use, a good part of the attainable improvements of this invention would be lost.

According to the invention, it is therefore proposed to use a low molecular gas of low specific weight and high specific heat as the working medium. Here first of all hydrogen or helium is offered. Helium is given an instantaneous preference since it is known to be an inert or noble gas.

These gases permit the full exploitation of the attainable disadvantages of the above described apparatus. This perhaps has its basis, according to the perception of the invention, in that only gases of this type in this situation result in high acceleration of the apparatus of the invention. This leads again to increased savings or diminishing of the detaching losses also known in the previous installations as the auxiliary energy.

A secondary circuit which is operated with the chosen working media or a working media of similar properties is provided for adaptation by the consumer on which high energy density is attainable with the inner heat transfer in the apparatus.

The secondary circuit can be controlled advantageously to depend on the movement of the displacer piston and on the thereby released shocklike heat thrust with simultaneous absorption of this heat thrust. The secondary circuit in this situation is for abstracting the concentrated heat supply.

Although, as stated above, the drive (impulse) can first be optionally shaped, in further construction of the invention this secondary circuit is likewise developed with a displacer piston having a regenerator which is under the influence of a controllable electromagnetic field whereby the displacer piston additionally can cooperate with an outer heat supply as a "hot gas motor".

The way the apparatus works permits advantageously a saving in manufacturing costs, as the displacer piston of the drive can be made the same as the displacer piston of the heat transfer device and inserted as a mirror image thereof.

The total arrangement yields, in addition to the described thermodynamic advantages, the further advantages of a pure linear discharge movement, as well for the drives as also for the heat transfer, with minimal functional losses and low frictional wear.

The piston rings of the working piston have to undergo, maximally and for only short periods, the pressure differential in both working spaces. The hydraulic superimpact given here means low frictional forces and therewith a corresponding movement of the mechanical efficiency of the apparatus.

While with the usual known apparatus for inner efficiency is dependent on the regulation of the delivery of power and is always worse with decreasing power, with the present apparatus it is nearly equal. This means that with the known machine the economical ranges of power regulation are fixed while with the apparatus of this invention almost any power regulation downwards is possible without essential influence on the efficiency since each working stroke can be initiated separately under preservation of like thermic and pressure proportions.

Further features of the invention and details thereof producing further advantages will be apparent from the following description of an embodiment of the invention shown somewhat schematically and by way of example in the accompanying drawing, wherein.

Figure 1:
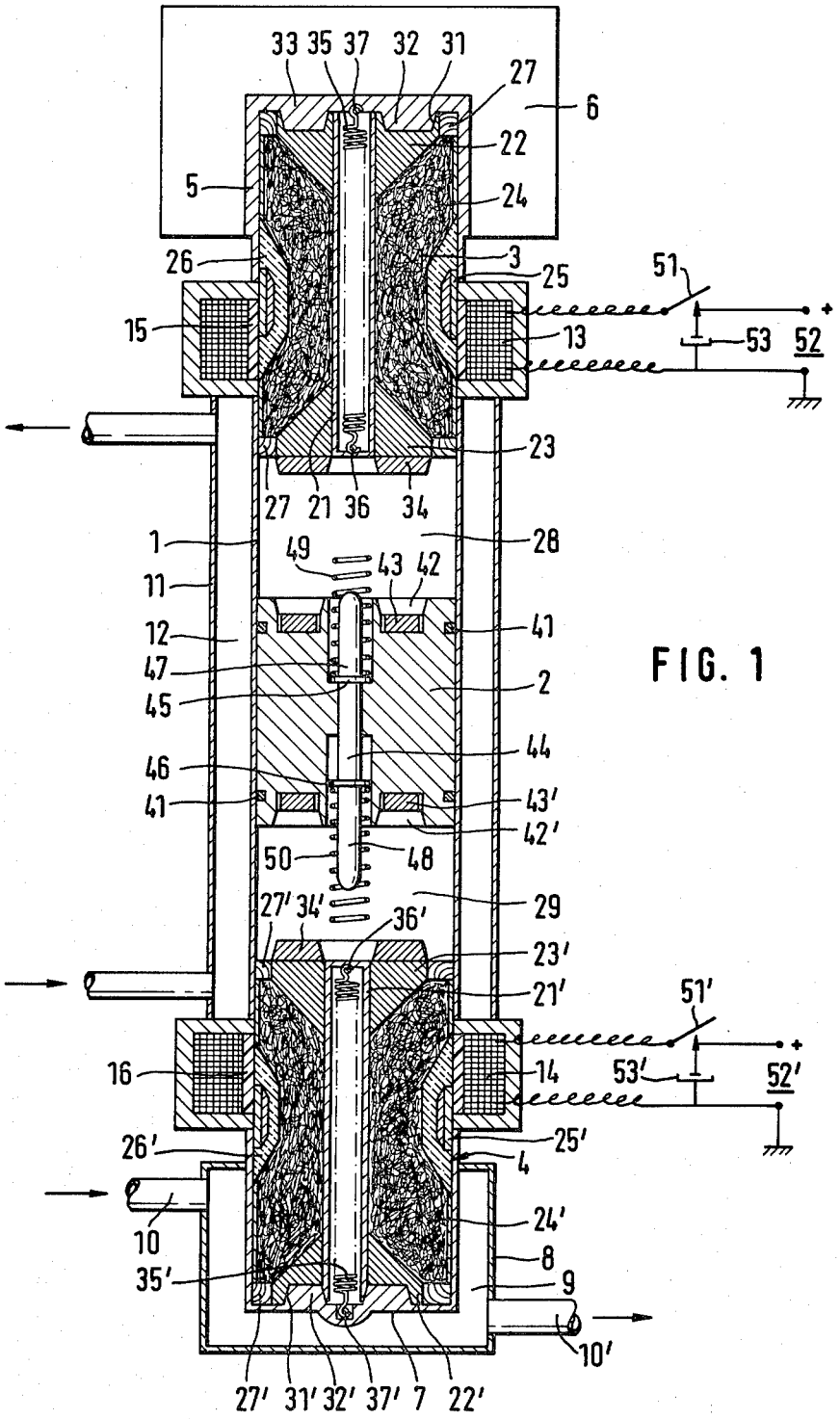
FIG. 1 shows the apparatus in longitudinal section.

The apparatus of the invention comprises a cylinder 1 closed to the outside and containing a working piston 2 as well as two impelling pistons 3 and 4. The cylinder 1 is equipped at its top end 5 with an outer heat source 6, not shown in detail, which is heatable to a prechosen maximal temperature through a control, likewise not shown. Accordingly the impelling piston 3 arranged in the top end 5 of cylinder 1 forms the drive of the apparatus shown. The apparatus is filled with a compressed gas as the working medium.

In the area of the lower side 7 of cylinder 1 an exchange arrangement is provided in which heat is supplied at pleasure from the outside by an additional medium. In the shown embodiment this heat is conducted off in a simple way through the ring space 9 formed by the outer mantle 8, to which space the medium is conducted through conduits 10 and 10'.

The central region, the range of movement of the working piston 2 of the cylinder 1, is surrounded by an annular space 12 formed by cylinder 11. Not only the heat supplied through the drive side but also the heat given off from the medium passing through the annular space 12 can always be used to advantage. Here, one is also dealing with the waste heat of the drive and the heat used in the exchangers. The casing mantle surfaces of cylinder 1, giving off heat not only for the drives, but also for the exchanger, lie adjacent to one another and can be played upon in the annular space 12 through the same or separate heat transport medium.

Electromagnetic field producing coils 13 and 14 are arranged outside the cylinder 1 for both impeller pistons 3 and 4. The coils 13 and 14 are insulated with relation to the cylinder 1 through non-magnetic or only weakly magnetic, heat-insulating rings 15 and 16.

The impelling pistons 3 and 4 comprise essentially a central tube 21, 21' on which two essentially cone form end parts 22, 22' and 23, 23' of good heat conducting material are set up. The remaining space is filled with heat exchange material, for example, tangled metal wire, to act as a regenerator. The impeller pistons have furthermore rings 25, 25' of ferromagnetic material which cooperate with the coils 13 or 14. Further, these rings 25, 25' are lodged in a completely enclosing ring-form body 26, 26' which consists of heat insulating material.

The two cone-form parts 22, 22' and 23, 23' are surrounded on the outsides of their foot-regions with twist producing means, for example, vanes 27, 27'. These are shown in the drawings for clarity, as developed. The outermost side of the cone-form parts 22 or 22' is provided with an annular recess 31 or 31' in which an annulus containing appendage 32 of the cylinder cover 33 or the front side of cylinder 1 interlocks. Recesses 31, 31' and rings 32, 32' have trapezoidal cross sectional form.

The other cone form parts 23, 23' are equipped with ring-form appendages 34, 34' of ferromagnetic material likewise of trapezoidal form in cross section.

In tubes 21, 21' a relatively weak tension spring 35, 35' is arranged which is fixed with its one end 36 on impelling piston 3 (or 36' on impelling piston 4) and with its other end 37, 37' fixed on the cylinder 1.

In the space between the two impelling pistons 3 and 4 a working piston 2 is arranged. The working piston is made of ferromagnetic material of high heat conductivity. It is guided in cylinder 1 in a known way with slide packing or piston rings 41. On both outer sides, annular form recesses 42, 42' are shown which are of trapezoidal form in cross section to correspond to the annular form appendages 34, 34' on the impeller pistons 3 and 4. At the bases of these recesses 42, 42' are annular-shaped permanent magnets 43, 43'.

The working piston 2 is penetrated by a rod 44 which can carry out a longitudinal movement over a certain range which movement is limited by stops 45 and 46. Compression springs 49 and 50 are shoved on the ends 47 and 48 of the rod 44 which in the relaxed state project beyond the ends of the rod 44 and beyond the outer surfaces of the working piston 2.

The coils 13 and 14 are connected over a switch 51, 51' to a current source 52, 52' with a parallel connected condenser 53, 53'.

The mode of operation of the apparatus of FIG. 1 is as follows.

In FIG. 1, the two impeller pistons 3 and 4 are found in each case in their end position and the working piston 2 nearly in the central position.

An optional heat source 6 heats the top end 5 of cylinder 1 up to a preselected temperature. When this temperature is attained, a command ensues on switch 51 whereupon a magnetic field of high intensity is produced through the coil 13, for example through an energy storage device such as a condenser 53. Therewith the ferromagnetic ring 25 in impeller piston 3 and therewith the entire piston is moved by the coil with great acceleration. As soon as or before the magnetic circuit, coil 13—ring 25, has been closed, the condenser 53 had either discharged or the circuit 51 had opened again. The impeller piston 3 has now attained a high speed and is moved forward under the influence of the stored mass energy until it arrives with its ferromagnetic ring 34 in the range of influence of the permanent magnet 43 on working piston 2. Simultaneously therewith the ring form recess 43 begins to act as a pneumatic brake, in which the ring 34 plunges into ring-form recess 42 under displacement of compressed gas with simultaneous decreasing flat click and finally comes into magnetic connection with the permanent magnet 43. Thereby the spring 49 is compressed in this operation.

Through this movement of impeller piston 3, gas is advanced from the cool space 28 through the recuperator 24 in which the gas is advanced through the heated space in top end 5 of cylinder 1 and has its pressure increased through heat absorption. Thus the gas leaves the regenerator 24 through the twist producing vanes 27 with a high speed (owing to the previously described high acceleration) as an regulated, refractive, spinning current. Through the produced pressure increase the coupled pair of pistons 3 and 2 will move in downward direction as shown in FIG. 1, towards the lower cold part of the apparatus. Thereby the gas in space 29 and in the bulk of recuperator 24' of impeller piston 4 is heated through compression. Thereby a part of the resulting heat is transmitted for disposal through the upright wall part of cylinder 1 to the medium in annular space 12. Another part of the resultant heat of compression is accumulated in the bulk of recuperator 24' of impeller piston 4. Also the recuperators 24, 24' come into the area in which they have contact with the walls of cylinder 1 to transfer heat to the cylinder.

After reaching a predetermined stroke length of the working piston 2, the coil 14 is connected over the switch 51' and the condenser 53' produces a magnetic field in the described way and thereby moves the impeller piston 4 against the working piston 2. Through the rod end 47, the impeller piston 3 is separated directly from the magnetic adherence of the permanent magnet 43 and moves back quickly to its initial position essentially under the influence of the springs 49 and 50 with cooperation of the weak spring 35. The now heated gas in top end 5 of cylinder 1 is passed through the recuperator 24 of piston 3 under pressure reduction and accumulated waste heat in the recuperator 24 in which it again forms cold space 28.

Under the influence of the now existing pressure reduction the magnetically coupled pair of displacer piston 4 and working piston 2 is moved in the opposite direction until by reaching a predetermined place a reversal of the previously described interplay of rod 44 and springs 50 and 49 as well as spring 35', separates the impeller piston 4 from its magnetic adherence on working piston 2 and accelerates it back to the initial position.

With the previously described discharge movement of the piston 4 there is formed in the end 7 of cylinder 1 a space with simultaneous reduction of space 29. The existing gas in the now relatively regarded heat space gets to space 29 in the already described way through the recuperator 24' of piston 4 in which it forms a relatively cold space in the end region 7. Thereby the heat of the working gas existing in the fashioned space is given off to the medium flowing through space 9. With reversal of the piston 4 into its initial position, the gas existing in the end area 7 gets through the recuperator 24' back into the space 29 and is heated additionally taking up previously stored heat. It gives up the heat taken up to the medium flowing through annular space 12 over the existing wall parts of cylinder 1.

According to a pv-diagram drawn in "Motorteil" with the piston 3 a work delivery process runs to the right, while in the work absorbing part a left running process takes place with piston 4. Both processes form pressure peaks which are overcome through selecting the mass of the working piston 2 with respect to gravity corresponding to the operation of a balance wheel. Many forms of means are known in the state of the art of kinematic ways to increase or correct the effect.

In the case described above it was assumed that on both parts, moving part and working part of the apparatus, the temperature leap would be about equal. This is not the case in other uses, the pressure variation discrepancy can be equalized through choice of a step piston in combination with appropriate different diameters of both areas.

Figure 2:
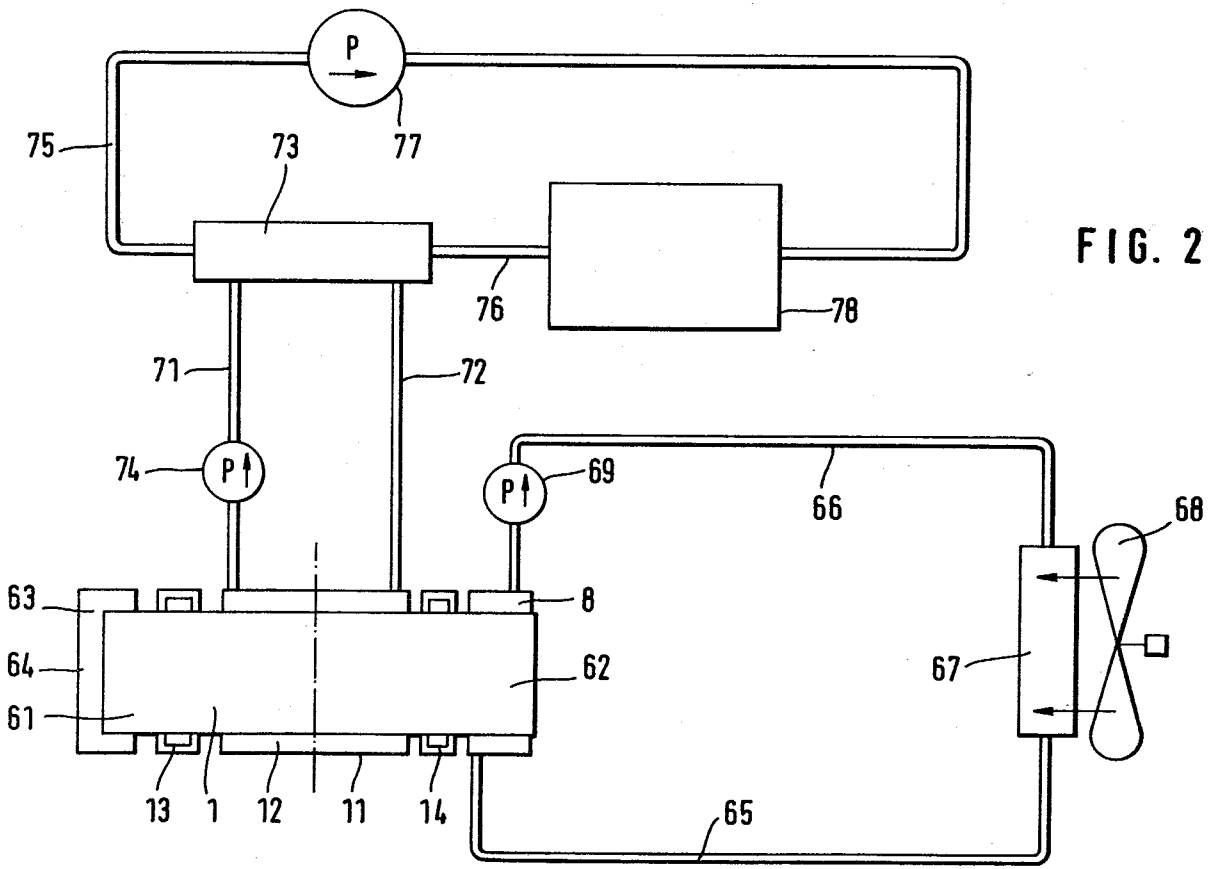
FIG. 2 shows an example of the employment of the apparatus.

In the employment example in FIG. 2 the apparatus of the invention is connected as the heat exchanger in a heat cycle, for example for heating a house. In cylinder 1 is arranged the combined drive/working apparatus from a motor 61 and a heat transformer 62 as just described in FIG. 1. At the left in FIG. 2 is the heating of motors through an outer arranged heat source with a temperature regulator is indicated. These are further equipped with both coils 13 and 14. The opposite end of cylinder 1 is surrounded by the ring space 8. The middle area of cylinder 1 is surrounded by the outer mantle forming annular space 12.

The annular space 8 is connected across conduits 65 and 66 to a typical heat exchanger 67 which withdraws heat for example over a blast 68 of outside air. Since the apparatus encapsulated in cylinder 1 itself is advantageously equipped with helium as the working material, it is again advantageous to also equip the circuit 8, 65, 66, 67 with such a low molecular gas as the heat exchange medium. In the circuit a pump 69 is arranged, whose pulsating forwarding power is controlled in dependence on the heat thrust of the apparatus.

The annular space 12 is connected across conduits 71 and 72 and to a heat exchanger 73 with the intermediate positioning of a pump 74 which again advantageously works pulsatingly. The other side of the heat exchanger 73 now delivers resultant heat over a suitably developed tube conduit system 75, 76 and again a pump 77 feeds the resultant heat on to the respective heat consumer 78.

In the indicated circuit, advantageously the conduits 71 and 72 convey a low molecular gas, for example, compressed helium. The circuit 75, 76 is, for example, a typical hot water loop.

The annular space 12, in the usual nomenclature, in its area to the left ot the dash point line can be designated and used as a "motor coller," and to the right of dash point line designated and used as a "condenser". Here, dependent on the actual use, the possibility to reuse the delivered heat quantities from different temperature levels is shown. There in the two loops or circuits, different media can be employed as the heat carrier.

We claim:

1. Apparatus for heat transformation comprising a cylinder closed to the outside, a working piston movably confined within a central part of said cylinder, at least one impact piston movably confined within and adjacent one end of said cylinder and including regenerator means, a heat transfer fluid acting as a working medium within said cylinder, means for supplying heat to the cylinder from the outside adjacent the end containing the impact piston, means to electromagnetically urge the impact piston towards the working piston, means for withdrawing heat from the outside surface of the cylinder.

2. The apparatus as claimed in claim 1 in which the working medium is a low-molecular weight gas of low specific weight and high specific heat.

3. The apparatus as claimed in claim 2 in which the working medium within said cylinder is hydrogen.

4. The apparatus as claimed in claim 2 in which the working medium in said cylinder is helium.

5. The apparatus as claimed in claim 2 in which the working medium in said cylinder is compressed.

6. The apparatus as claimed in claim 2 in which the working medium in said cylinder is a mixture of gases.

7. The apparatus as claimed in claim 1 comprising a secondary impact piston operable from the end opposite to that of the first impact piston and a working medium within this opposite end of the cylinder, said latter working medium being at least similar to the working medium of the first impact piston.

8. The apparatus as claimed in claim 7 comprising means for control of the working medium in the region of the secondary piston, said means being controllable by the movement of the impact piston and the released shock-like heat thrust provided thereby.

9. The apparatus as claimed in claim 1 and wherein said secondary impact piston is constructed with a regenerator means similar to that of the first impact piston and also is impelled by electromagnetic means similar to the first impact piston.

10. Apparatus as claimed in claim 9 wherein said second impact piston is the mirror image of the first impact piston.

11. Apparatus as claimed in claim 1 and wherein the cylinder has heat-abstracting, mantle surfaces adjacent the drives as well as the neighboring absorbers.

12. The apparatus as claimed in claim 1 comprising an electromagnetic coil for creating said electromagnetic field surrounding said cylinder and non- or weakly-magnetic means between the coil and said cylinder acting as a heat insulating ring.

13. The apparatus as claimed in claim 1 and wherein each impact piston comprises an outer tube and a central tube, a pair of conical formed end parts of heat conducting material with the small ends of the cones extending inwardly, a ferromagnetic ring surrounding the central portion of said outer tube, an insulating ring shielding the ferromagnetic ring from the interior of the piston, the remainder of said interior filled with heat exchange- and heat storage material.

14. The apparatus as claimed in claim 13 wherein the foot region of said cones are surrounded by means for producing twist in gas flowing therethrough.

15. The apparatus as claimed in claim 13 wherein the top side of the top cone part of the piston contains an annular recess of trapezoidal cross section, the top portion of said cylinder containing an annular ring of trapezoidal cross-sectional shape interfitting with said annular recess whereby to improve the heat transfer and to dampen the impact between the parts.

16. The apparatus as claimed in claim 1 and wherein the interior end of said interior conical end of the impact piston contains an annular deposit of trapezoidal cross section formed of ferromagnetic material, the end of the working piston nearest said annular deposit having an annular recess therein and a permanent magnet positioned in the lower part of said recess.

17. The apparatus as claimed in claim 13 wherein said central tube of the impact piston contains a tension spring, the interior end of the spring being attached to the impact piston and the other end tkereof being attached to the cylinder.

18. The apparatus as claimed in claim 7 comprising two impact pistons, one on each side of the working piston, said working piston having a shiftable rod extending therethrough, a pressure spring shoved on each end of the rod and projecting beyond the ends of the rod and beyond the end of the working piston.

19. Apparatus as claimed in claim 18 wherein said working piston is a stepped piston.

20. Apparatus as claimed in claim 1 and comprising an additional heat exchange circuit conn4cted to the outside of said cylinder, said additional heat exchange circuit containing a low molecular, compressed gas of low specific weight and high specific heat as the heat transfer means.

21. Apparatus as claimed in claim 20 wherein the outside heat exchange circuit comprises a pulsating pump dependent on the heat thrust in said cylinder.

22. Apparatus as claimed in claim 20 comprising in cooperation an outside circuit connected to the middle region of said cylinder.

23. Apparatus as claimed in claim 20 comprising two outer circuits cooperating with the middle region of said cylinder.

24. The apparatus as claimed in claim 23 wherein the two outer circuits are filled with different heat transport media.

* * * * *